US005205004A

United States Patent [19]

Hayes et al.

[11] Patent Number: 5,205,004

[45] Date of Patent: Apr. 27, 1993

[54] VERTICALLY ADJUSTABLE AND TILTABLE BED FRAME

[75] Inventors: Stephen Hayes, Dudley; Robert H. Jones, Tipton, both of Great Britain

[73] Assignee: J. Nesbit Evans & Co. Ltd., Great Britain

[21] Appl. No.: 785,274

[22] Filed: Oct. 30, 1991

[30] Foreign Application Priority Data

Nov. 28, 1990 [GB] United Kingdom ..... 9025897
Apr. 6, 1991 [GB] United Kingdom ..... 9107277

[51] Int. Cl.[5] ..... A61G 7/005; A61G 7/012; A61G 7/015; A61G 7/018

[52] U.S. Cl. ..... 5/611; 5/618

[58] Field of Search ..... 5/611, 616, 618, 424

[56] References Cited

U.S. PATENT DOCUMENTS

| | | | |
|---|---|---|---|
| 3,913,153 | 10/1975 | Adams et al. | 5/616 |
| 4,361,917 | 12/1982 | Wilson | 5/616 |
| 4,435,862 | 3/1984 | King et al. | 5/616 |
| 4,745,647 | 5/1988 | Goodwin | 5/618 |
| 4,769,584 | 9/1988 | Irigoyen et al. | 5/616 |
| 5,161,274 | 11/1992 | Hayes et al. | 5/618 |

*Primary Examiner*—Alexander Grosz
*Attorney, Agent, or Firm*—Learman & McCulloch

[57] ABSTRACT

A vertically adjustable and tiltable bed frame has two actuators which may be used simultaneously or independently to tilt the frame and which also may be used to raise and lower the frame. A level sensor is connected to the actuators so that if the tilt varies from the adjusted and desired position, one or other actuator is adjusted to restore the desired tilted position.

8 Claims, 5 Drawing Sheets

VERTICALLY ADJUSTABLE AND TILTABLE BED FRAME

This invention relates to beds, patient trolleys and like person supports (herein called beds) of the kind comprising a frame or platform (herein called platform) to carry the person—usually with a mattress interposed—and with means for varying the height of said platform.

One design, to which this invention relates, but without limitation thereto, comprises a wheeled chassis with two fixed parallel transversely extending pivot shafts. A pair of bell cranks is supported on each shaft. One end of each crank is hinged to the underside of said platform. The other ends of the cranks are coupled together and an actuator is connected between them so as to turn the cranks in unison. This brings about the raising or lowering. An example of such a bed is to be found in Patent EP 0 095 538 A. In said patent, the actuator is a mechanical jack.

It is also known to use an electrical actuator instead of the jack, for example an electric motor driving a screw and nut mechanism or the like. This has the advantage of requiring minimal effort by the operator, to press a button instead of for example foot operation of a lever on a mechanical jack.

Such a bed can be tilted, as is required for certain medical procedures by mounting the mattress frame on a pivot at one end and with an adjustable position link and catch means at the other end. To tilt, the catch is released, the mattress is adjusted for example against or by a gas spring, and the catch re-engaged.

The object of the invention is to provide an improved bed of the character referred to.

According to the invention a bed is characterised by the provision of separate power operated actuators, one for the head end and one for the foot end of the bed, and a level sensor connected to both actuators and arranged to maintain the angle of the platform relative to the sensor by adjusting power supply to the respective actuators.

The level sensor has the important effect of enabling the normal angle of the bed (for example but without limitation, level or zero) to be maintained even if the bed is unequally loaded. If someone sits on one end of the bed when it is to be raised, the actuator at that end has a greater load and without the level sensor the bed would assume unwanted tilt.

Preferably the actuators are low voltage and preferably reversible electric motors, for example 24 volts, so as to enable the bed to be battery powered at least when being moved from place to place, for example between a hospital ward and an operating room.

The power adjustment may be voltage variation.

Although it would be within the scope of the invention to adjust tilt by reducing power to one actuator while maintaining full power on the other, it is preferred to drive the actuators oppositely for this purpose. The precise details of this will depend upon layout. However, if both actuators are driven in the same direction to bring about lift or lower without (intentional) tilt variation, then one is reversed to bring about a required tilt variation. If one actuator reaches the end of its stroke before the desired variation is attained, then the other carries on until it is completed. This e.g. avoids the mattress 'fouling' on other components.

According to a feature of the invention the level sensor is settable to enable the level to be adjusted. Hence it can be set horizontal, that is for a condition of the mattress platform parallel to level ground or 0 deg., or at any desired angle thereto. Hence, a desired tilt may be brought about by changing the position of the setting. The sensor then powers the actuators to move the platform until its angle coincides with the setting. This feature also enables rapid resetting of angle, for example restoration of a level condition simply by resetting the sensor.

The level sensor could be a known pendulum switch mounted on the movable and tiltable part so that it can be set parallel to the part or at any angle thereto: the circuitry will cause the motors to adjust tilt until it is again horizontal. Alternatively the same effect may be attained by the use of known position indicators, which are to be considered as level sensors within the meaning of the words used in this specification. Thus, a rotary potentiometer may be used in a pivot to give a variable resistance which is an analog of the angular position, or the actuator may have a rod which is displaced by the movement, and the measurement of the displacement can be used as an indication of the adjustment, and via a conventional microprocessor memory of the level attained.

Preferably the level sensor is mounted on the mattress frame in a position inaccessible to the patient, for example on the side of the mattress support near the foot of the bed, or below the mattress generally centrally.

The circuitry may be associated with a hand control for example one having one switch or push-button which can be pressed to operate both actuators to bring about elevation of the mattress platform, and another which can be similarly actuated to bring about normal lowering.

One presently preferred embodiment of the invention is now more particularly described with reference to the accompanying drawings wherein.

Figure 1:
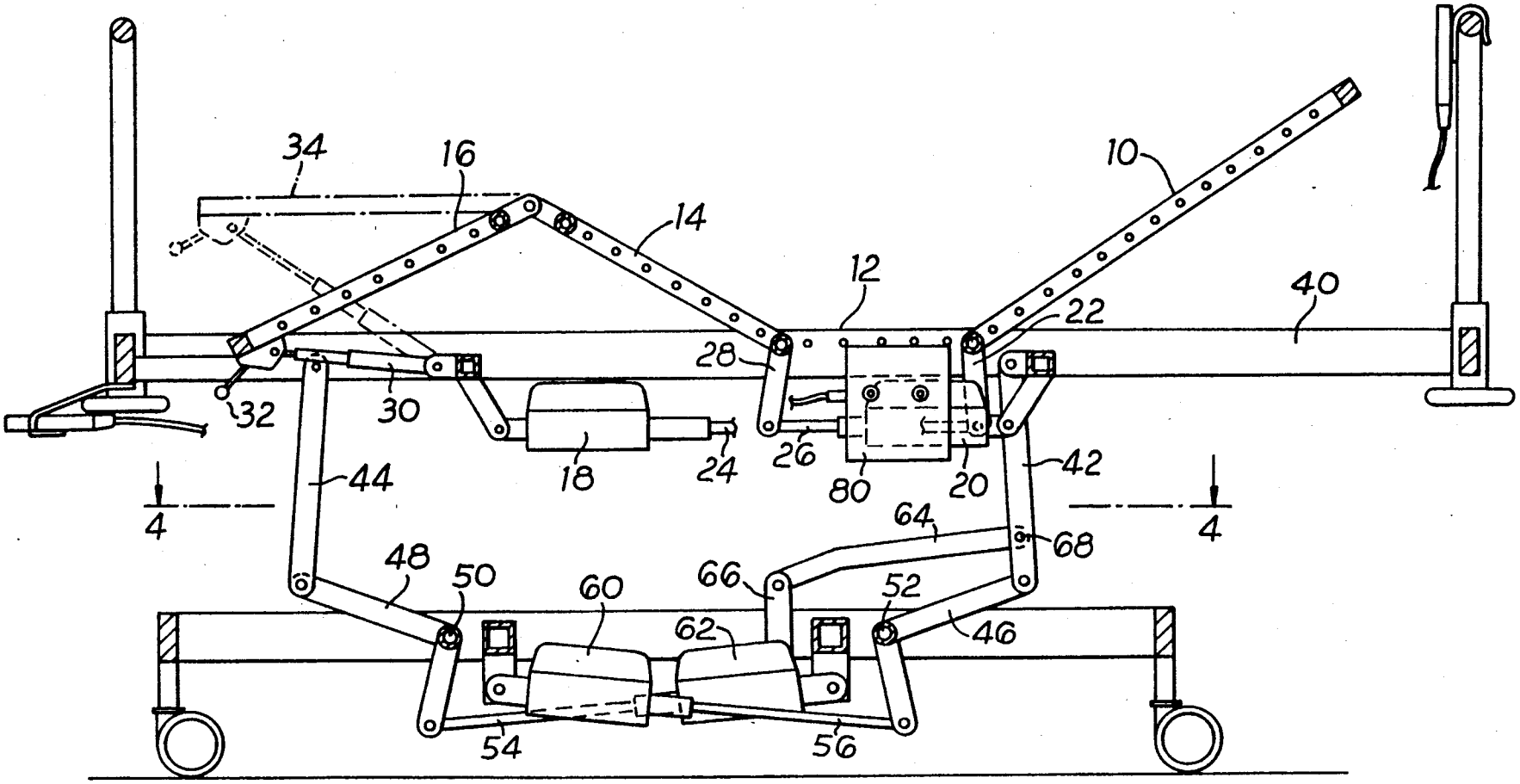
FIGS. 1-3 are side elevations of a bed in three different positions.

Referring to the drawings, the bed shown therein may have a profiling action as shown in FIG. 1 in which successive mattress support frame portions 10, 12, 14 and 16 are hinged or profiled to form a backrest, buttock support, thighrest and legrest respectively. This movement is achieved by the use of a pair of actuators 18, 20, the first of which (18) is connected to crank 22 by rod 24 (shown broken away in FIG. 1 for the purposes of clarity) and the second of which (20) is similarly connected by rod 26 to crank 28. The arrangement may be such that when the backrest portion 10 is steepened in angle, the thighrest 14 is steepened but at a proportionally lower rate, and legrest 16 is pivoted to the thighrest 14. A telescopically adjustable strut 30 with a catch 32 for release from a lock position enables the legrest to be moved to the horizontal position shown in chain dot line at 34 or any other position as required for patient care.

Figure 2:
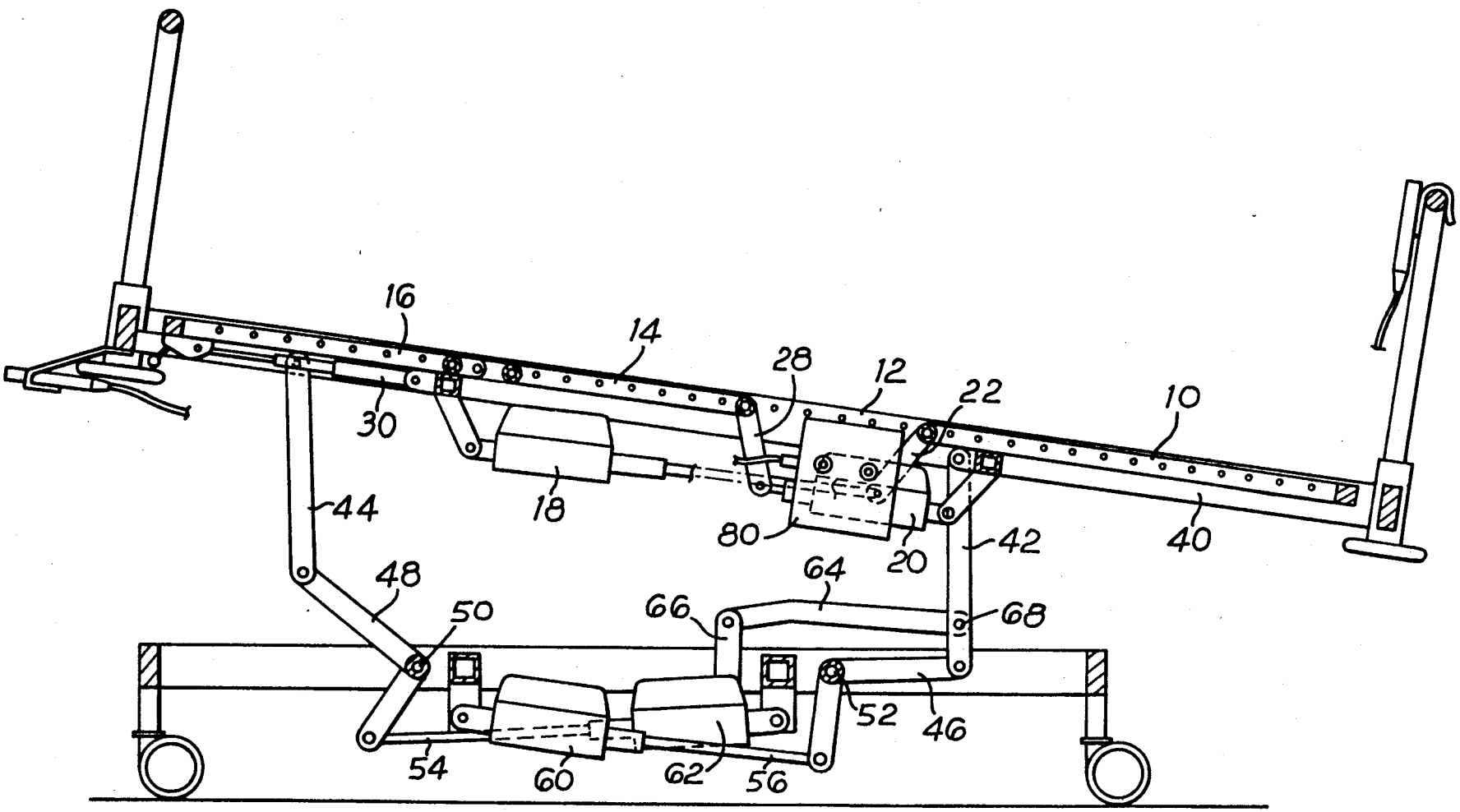
Figure 3:
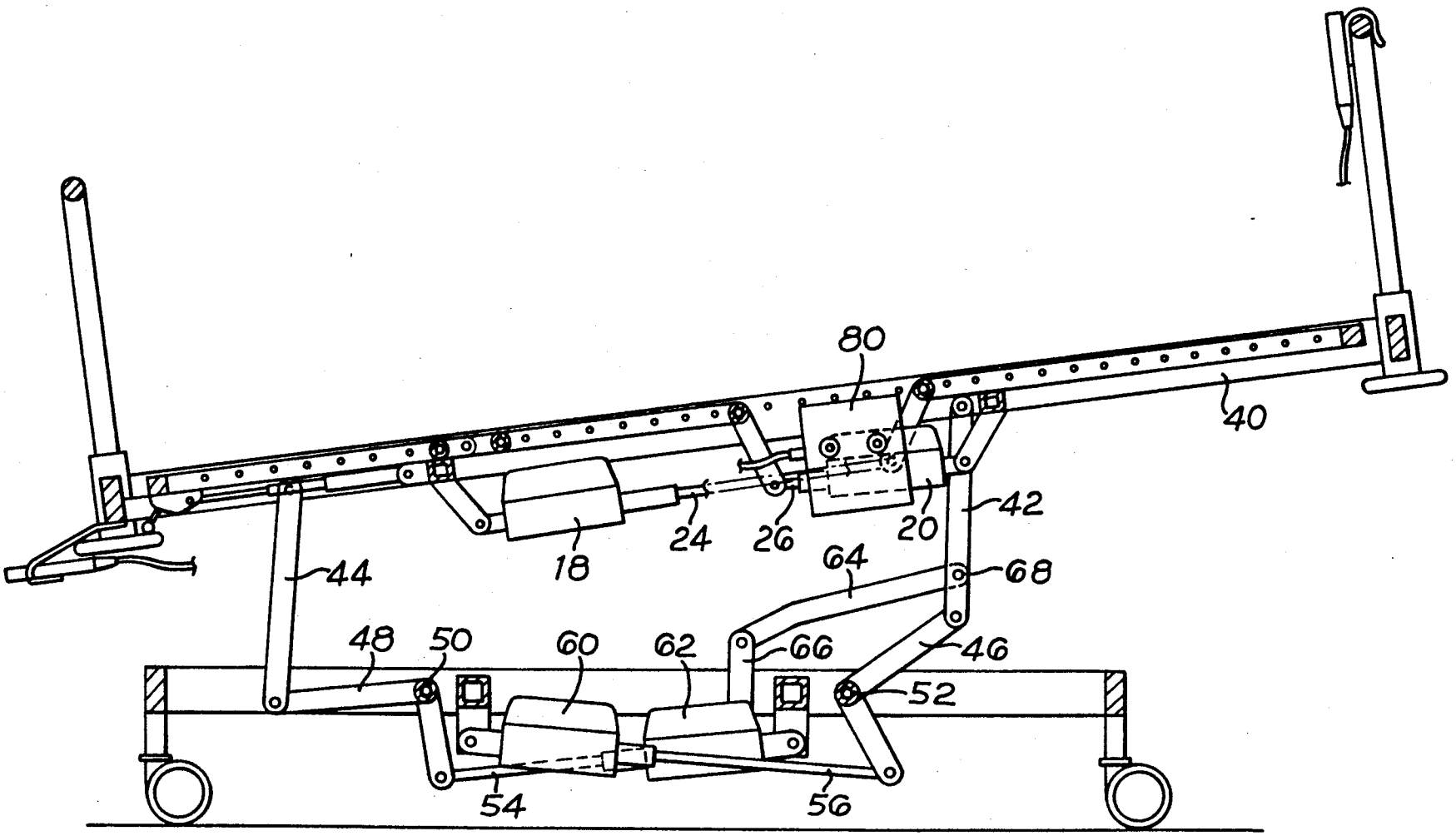

FIGS. 2 and 3 show the profiling section moved to co-planar condition. These mattress support sections are mounted on a common framework 40 which is freely pivoted to upwardly extending struts 42, 44 which in turn are pivoted to cranks 46, 48 pivoted on cross shafts 50, 52 and connected respectively to the rods 54, 56 of a further pair of actuators 60, 62. A control link 64 is pivoted between a fixed bracket 66 and a point 68 on the link 42 to maintain link 42 in a generally vertical position during movement of the crank 46 in lifting or lowering that link 42.

The actuators 60, 62 are low voltage motors which drive their respective rods 54, 56 through a recirculating ball nut device, but actuators of this kind are freely available from a number of sources and require no further description to those skilled in the art.

Figure 5:
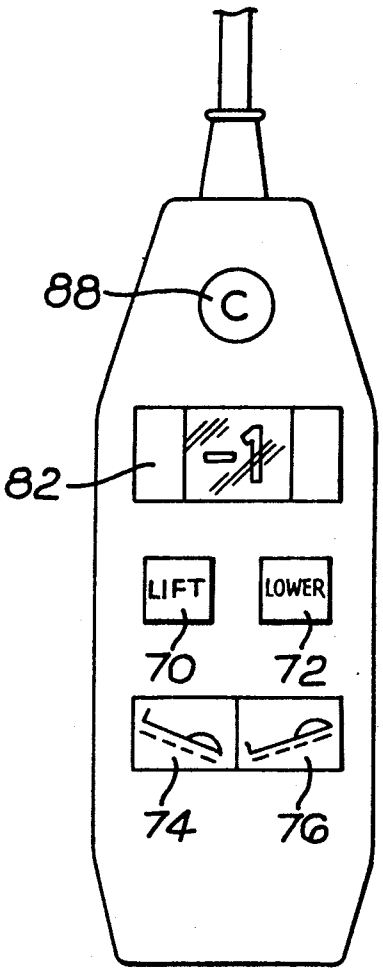
FIG. 5 shows a handset controller.
Figure 4:
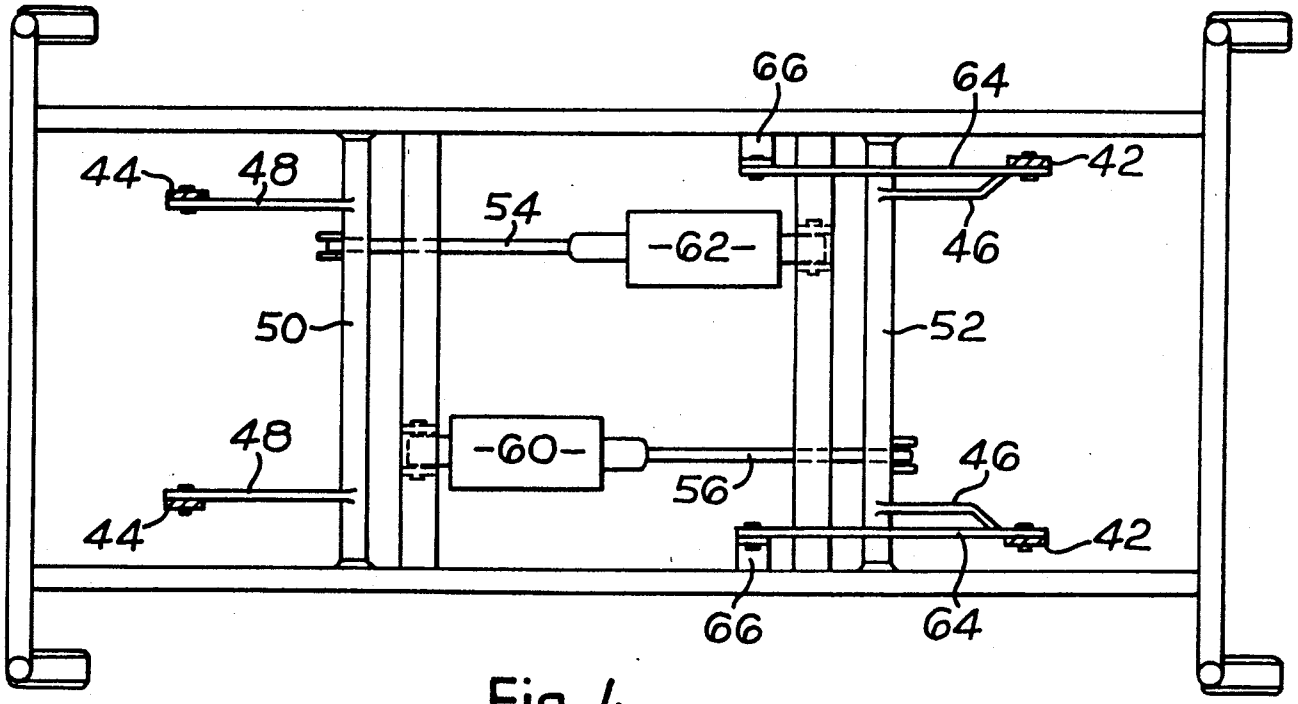
FIG. 4 is a sectional plan view taken on the line 4—4 of FIG. 1.
Figure 6:
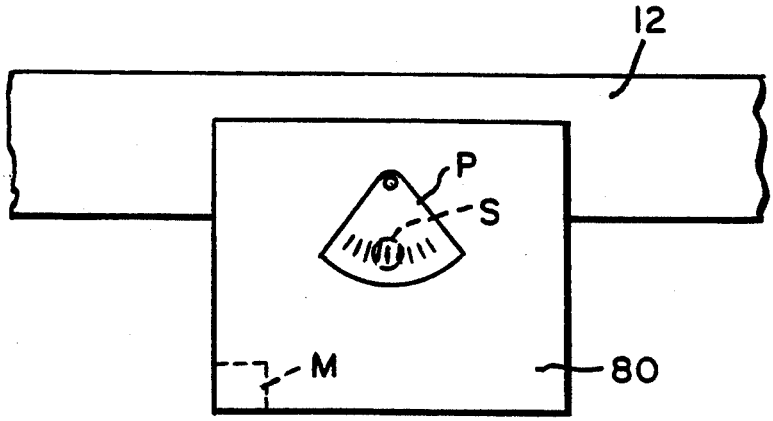
FIGS. 6 and 7 are fragmentary views showing control apparatus in two positions of tilted adjustment of the bed frame.
Figure 7:
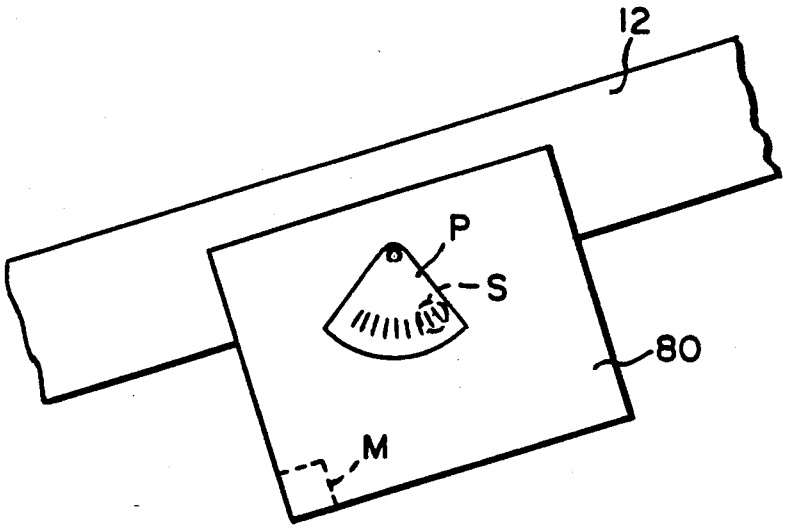

The mattress frame 40 may be lifted and lowered and adjusted in tilt or maintained at a required angle by control means. The control means may include a handset such as that shown in FIG. 5 having a button 70 which is pressed to supply current to both actuators 60, 62 so as to lift the mattress frame. A further button 72 is pressed to lower the mattress frame by supplying current of the opposite polarity to both actuators. A further pair of buttons 74, 76 is provided for causing increase in tilt relative to the horizontal in one direction for example to raise the footrest end of the bed, and the other button 76 for causing the opposite movement to raise the head end of the bed.

A typical control mechanism within the scope of the invention may be mounted in a control box 80 fixed to the frame portion 12 and comprises a pendulum-like member P freely pivoted to hang in a vertical position, while the control box includes sensors mounted on the box and which thus move relative to the pendulum if the angle of inclination of the mattress changes. The pendulum may carry graduations which generate signals in the sensor S for transmission to the memory of a microprocessor M in one or other direction according to whether the angle is changing in a positive or negative sense i.e. clockwise or anticlockwise movement, and the handset may include a readout 82 giving an indication of the actual angle of the mattress frame relative to the horizontal or zero.

The control system operates so that if either a button 70 or 72 is pressed, the same voltage is fed to both actuators 60, 62 in the sense to cause lifting or lowering as the case may be but without intentional adjustment of angle. If the angle shifts during that lifting or lowering, for example because the mattress frame is unequally loaded, and one example of this would be due to someone sitting on one end of the bed or some heavy equipment such as oxygen cylinders is on one end of the bed, then the one motor will have a greater load than the other and the angle of tilt will change. This will cause the sensor to move relative to the pendulum, control signals to be generated, and, as a result of a microprocessor action, this will bring about an adjustment of the current supply to one or other of the motors in the sense which will bring about a restoration of the angle.

The handset may include a further or second control button 88 used under 'crash' conditions when it is required to restore the bed to a level condition and possible also to a minimum height as quickly as possible, and the purpose of this is to bring circuitry into play to cause such operation of the actuators 60 and 62 as is necessary for this purpose without the operatives such as nurses having to consider which of the other buttons needs to be pressed for that purpose.

Preferably the circuitry also includes an inherent delay of the order of say 2 or 3 seconds which comes into operation whenever the mattress frame is being tilted and it reaches a condition of zero tilt. This facilitates levelling of the bed without the risk of overshooting.

In summary, a first possibility for positional control is the described pendulum or like arrangement which moves with the mattress, and generates a signal which can be stored in memory and/or compared with a memory setting of a microprocessor M so as to cause variation in the power supply to one or other or both actuators so as to restore a required angle of tilt or bring about a required angle of tilt; a second possibility is to sense the angle of a part of the bed relative to a pivot axis, for example the angle of the part 40 or the angle of one of the cranks. This can likewise be used in the same way to bring about adjustment. A third possibility is to use the position of the rods 54, 56, that is to say the extension of these relative to the actuators for like purposes. This can be done for example by a mechanical drive between the rod and a control device such as a rack and pinion drive, or by providing graduations or indicia on the rods which are effective on sensor in generally the same way described in relation to the pendulum: the advantage in the case of using the rods is the relatively large movement taking place between the minimum and maximum positions of the rod and hence the possibility of accurate and fine adjustment.

We claim:

1. A bed comprising a frame having a head end and a foot end; means mounting said frame for vertical movements and for tilting movements from and to a substantially horizontal position; first actuating means coupled to said frame for raising and lowering said head end; second actuating means coupled to said frame for raising and lowering said foot end; first and second operating means coupled to the respective first and second actuating means for operating said first and second actuating means to tilt said frame to a selected tilted position relative to the horizontal; and control means coupled to said first and second actuating means, said control means adapted to adjust the power supply to the respective activating means and operable to effect conjoint operation of said first and second actuating means for selectively raising and lowering said frame while said frame remains in a constant selected tilted position regardless of the uneven loading of the ends of the frame.

2. A bed according to claim 1 wherein each of said actuating means comprises a reversible electric motor.

3. A bed according to claim 2 wherein each of said electric motors operates on a power supply voltage up to about 24 volts.

4. A bed according to claim 3 wherein the power supply voltage of each of said motors is adjustable.

5. A bed according to claim 1 wherein said control means comprises a level sensor settable in a position corresponding to that said level sensor will occupy when said frame is in said selected tilted position.

6. A bed according to claim 5 wherein said level sensor comprises a pendulum swingably mounted on said frame.

7. A bed according to claim 5 wherein at least one of said actuating means comprises an extensible and retractable rod which is displaceable in response to tilting movement of said frame by operation of said one of said actuating means, displacement of said rod being cooperable with said level sensor to discontinue operation of said one of said actuating means when said frame is in said selected position.

8. A bed according to claim 1 including further operating means coupled to said first and second actuating means for operating said first and second actuating means simultaneously to move said frame from said selected tilted position to said substantially horizontal position.

* * * * *